United States Patent [19]

Steacy

[11] Patent Number: 4,762,217

[45] Date of Patent: Aug. 9, 1988

[54] ESCALATOR HANDRAIL GUIDE

[75] Inventor: Robert J. Steacy, Collinsville, Conn.

[73] Assignee: Otis Elevator Company, Farmington, Conn.

[21] Appl. No.: 129,635

[22] Filed: Dec. 7, 1987

[51] Int. Cl.[4] ..... B66B 23/24

[52] U.S. Cl. ..... 198/337

[58] Field of Search ..... 198/337, 338, 335; 52/400, 767, 768, 775, 825

[56] References Cited

U.S. PATENT DOCUMENTS

| | | | |
|---|---|---|---|
| 1,186,551 | 6/1916 | Cobb | 198/337 |
| 2,028,358 | 1/1936 | Shonnard | 198/337 |
| 3,949,858 | 4/1976 | Ballocci et al. | 198/337 |
| 3,981,118 | 9/1976 | Johnson et al. | 198/335 X |
| 4,423,582 | 1/1984 | Yates | 52/825 |
| 4,598,811 | 7/1986 | Hanano et al. | 198/335 |
| 4,658,946 | 4/1987 | Adrian et al. | 198/337 |
| 4,666,028 | 5/1987 | Saito et al. | 198/335 |
| 4,705,155 | 11/1987 | Kanamori | 198/335 |

FOREIGN PATENT DOCUMENTS 2143194 2/1985 United Kingdom .

*Primary Examiner*—Robert J. Spar
*Assistant Examiner*—D. Glenn Dayoan
*Attorney, Agent, or Firm*—W. Jones

[57] ABSTRACT

The guide rail is one which is adapted to be mounted on a glass balustrade on an escalator. The mounting is accomplished without the need to drill holes in the balustrade or to apply any adhesive to the balustrade. The guide is formed with a groove in its lower surface which receives the top edge of the balustrade. The groove is flanked by gripping legs, one of which can be tightened against the balustrade by means of set screws, in the manner of a vise. The set screws are threaded into a handrail slide portion of the guide and are completely recessed therein so as not to interfere with the handrail.

4 Claims, 1 Drawing Sheet

ESCALATOR HANDRAIL GUIDE

TECHNICAL FIELD

This invention relates to a handrail guide for an escalator, and more particularly to a guide which can be clamped onto a glass balustrade without the need to drill holes in the glass.

BACKGROUND ART

Escalators and moving walkways, such as may be found in airports or the like, are frequently provided with glass sides or balustrades upon which are mounted moving handrails. The handrail slides over a guide member which in turn is secured to the balustrade. A number of different systems have been developed for securing the guide rail to the balustrade. These systems include the use of adhesive for gluing the guide to the balustrade, bolts and clamps for clamping the guide to the balustrade, and the use of bolts or screws for stressing the guide rail so that it can be clamped on the glass balustrade. Disclosures which typify the aforesaid securement systems are found in U.S. Pat. No. 2,028,358 Shonnard; U.K. Patent Document No. 2,204,471; U.K. Patent Document No. 2,143,194; and U.K. Patent Document No. 2,152,002. The prior art systems described above have shortcomings which are as follows. The use of an adhesive is very messy and very difficult to disassemble. Bolting the guide to the glass involves many component parts, and also requires drilling holes through the glass which is undesirable. U.S. Pat. No. 4,658,946 Adrian et al, discloses a handrail guide which is clamped onto a glass balustrade by means of its inherent springiness, wherein the clamping force cannot be varied.

DISCLOSURE OF THE INVENTION

This invention relates to a handrail guide for use on an escalator or moving walkway, which guide can be clamped onto a glass or planar metal balustrade without the need to drill any holes in the balustrade. The guide of this invention can be attached to the balustrade without using any adhesive, and without using any auxiliary clamps or bolts. The clamping mechanism is an integral part of the rail guide and can be adjustably clamped onto the balustrade with varying degrees of clamping force. The guide is a one-piece metal member which is axially elongated and can be formed by extruding or by machining. The guide is generally T-shaped in cross-section, and has its upper surface contoured with oppositely facing flanges or arms to form a low friction surface over which the handrail fits and can slide. The bottom of the guide has a closed ended medial groove which extends axially of the guide and into which the top of the balustrade fits. The medial groove divides the bottom of the guide into opposed clamping legs which merge into the top portion of the guide. One of the clamping legs has a basal slot cut therein transverse to the balustrade-receiving groove and underlying one of the rail-engaging arms on the top of the guide. The basal slot stops short of the medial groove so that a springy connection is formed between the undercut clamping leg and the upper portion of the guide. The arm which overlies the basal slot has a plurality of axially spaced drilled and tapped through passages formed therein for reception of set screws. The set screws are tightened down into the through passages and against the lower side of the basal slot to force the undercut leg to pivot about the springy connection and toward the other leg thereby gripping the balustrade disposed in the groove.

It is therefore an object of this invention to provide an improved handrail guide for use in an escalator or moving walkway, which guide can be secured to a balustrade without the need to drill holes in the balustrade.

It is a further object of this invention to provide an improved hand rail guide of the character described which can be selectively tightened onto the balustrade with varying degrees of clamping force.

These and other objects and advantages of the invention will become more readily apparent from the following detailed description of a preferred embodiment of the invention when taken in conjunction with the accompanying drawings.

BEST MODE FOR CARRYING OUT THE INVENTION

Figure 1:
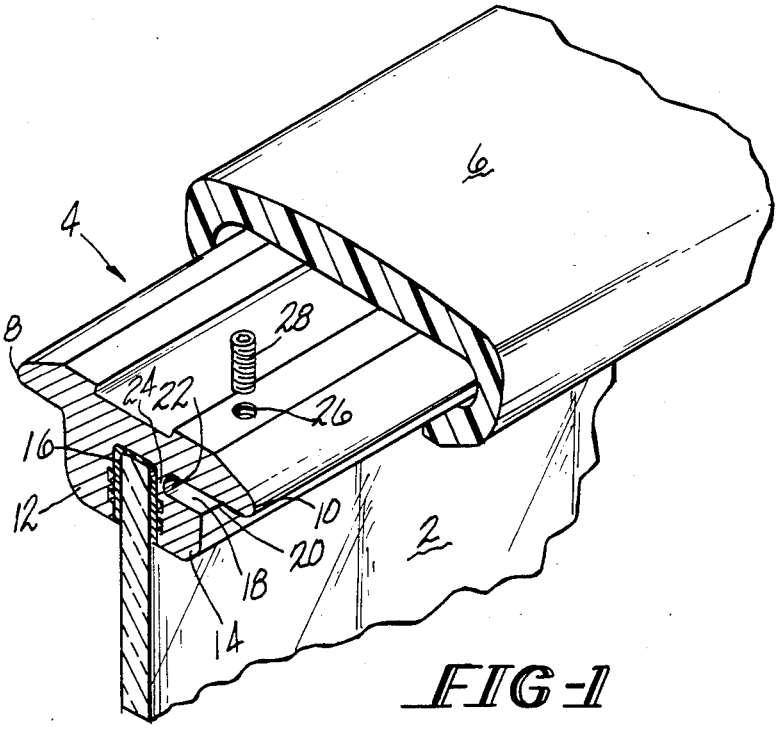
FIG. 1 is a fragmented perspective view, partially in section of a preferred embodiment of a handrail guide formed in accordance with this invention.
Figure 2:
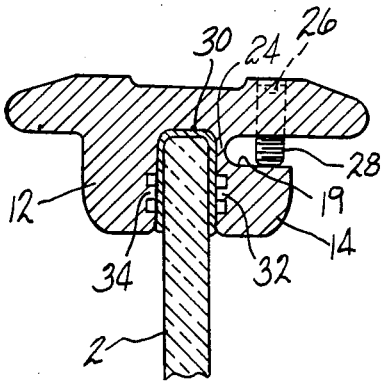
FIG. 2 is a cross sectional view of the guide and balustrade taken on a plane perpendicular to the direction of elongation of the guide.

Referring to the drawings, the glass balustrade is denoted by the numeral 2, the guide is denoted generally by the numeral 4, and the moving handrail is denoted generally by the numeral 6. The guide 4 is generally T-shaped in cross-section and includes two transversely outwardly extending arms 8 and 10 which merge into a pair of clamping legs 12 and 14. A medial groove 16 is interposed between the legs 12 and 14 to receive the top marginal portion of the balustrade 2. A transverse slot 18 is formed in the leg 14 adjacent to the arm 10, the slot 18 having an open end 20 distal of the groove 16 and a closed end 22 proximal of the groove 16. A flexible pivot 24 is formed between the side of the groove 16 and the closed end 22 of the slot 18 about which the leg 14 can be pivoted. A threaded bore 26 extends through the arm 10 and is positioned so that its axis passes through the leg 14 outwardly of the pivot 24. A set screw 28 is received in the bore 26 in the manner shown in FIG. 2. A gasket 30 made of paper or similar compliant material can be mounted in the top of the balustrade 2 to increase friction and to provide a yielding member into which teeth 32 and 34 formed on the side walls of the groove 16 can bite.

After the gasket 30 is positioned on top of the balustrade 2, the guide 4 is mounted on the gasket 30 and balustrade 2. The set screws 28 are then threaded into the passages 26 until their lower ends abut the bottom bearing surface 19 of the slot 18. Continued tightening of the set screws 28 will pivot the leg 14 about the pivot 24 and toward the leg 12. This will cause a clamping action on the balustrade 2 in the groove 16 by the legs 12 and 14. The guide 4 can thus be adjustably tightened onto the balustrade. The set screws 28 will be tightened to a level below the top of the arm 10 so as not to interfere with movement of the handrail 6.

It will be readily appreciated that the hand rail guide of this invention can be readily and easily formed from stainless steel, bronze, or other suitable metal. The guide can be quickly and securely mounted on the balustrade without the need to drill holes in the balustrade and without otherwise damaging the balustrade. The assembly includes a minimum number of component parts and can be assembled and disassembled without special tools.

Since many changes and variations of the disclosed embodiment of the invention may be made without departing from the inventive concept, it is not intended to limit the invention otherwise than as required by the appended claims.

I claim:

1. A handrail guide for controlling movement of a sliding handrail in a people conveying assembly, said guide comprising:

(a) an axially elongated solid metal body having a generally T-shaped cross-sectional configuration;

(b) first and second oppositely extending transverse arms forward on said body, said arms forming a part of the guide over which the handrail slides;

(c) first and second legs on said body extending generally perpendicularly from proximal portions of said arms, said legs being spaced apart to form sides of a groove in said body adapted to receive a top edge portion of a balustrade part of the conveying assembly;

(d) a transversed slot formed in said body, said slot undercutting a portion of one of said legs immediately adjacent to a corresponding one of said arms, said slot having a closed end proximal said groove to define a pivot portion of said body about which relative movement of said legs can occur;

(e) means forming a plurality of threaded openings extending through said corresponding one of said arms at locations spaced axially along said body, said openings each having its central axis substantially perpendicular with a bearing surface formed on said one of said legs by said slot; and (f) means for threading into said threaded openings for tightening therein against said bearing surface to cause relative movement of said legs toward each other whereby the guide can be clamped to the balustrade part of the conveying assembly.

2. In a people conveying assembly, a handrail-balustrade subassembly comprising:

(a) a planar balustrade formed from a plate of glass or metal;

(b) a handrail guide mounted along a top edge portion of said balustrade, said guide being axially elongated and having a generally T-shaped cross-sectional configuration with first and second oppositely extending transverse arms forming a part of the guide over which the handrail slides; said guide further comprising first and second legs extending generally perpendicularly from proximal portions of said arms, said legs being spaced apart from each other to define an intermediate groove on a lower portion of said guide into which said top edge portion of said balustrade extends; a transverse slot formed in said guide, said slot undercutting a portion of one of said legs to form a bearing surface thereon immediately adjacent to a corresponding one of said arms, said slot having a closed end proximal said groove to define a pivot portion of said guide about which relative movement of said legs can occur and means forming a plurality of threaded openings extending through said corresponding one of said arms; and (c) screw means for threading into said threaded openings, said screw means being operable to engage said bearing surface upon tightening into said threaded openings, to cause relative movement of said legs toward each other whereby the guide is clamped tightly onto said balustrade.

3. The assembly of claim 2, further comprising a gasket member mounted on said top edge portion of said balustrade for engagement by opposed sides of said legs.

4. The assembly of claim 3, further comprising means forming teeth on said opposed sides of said legs for biting into said gasket member.

* * * * *